US012376673B2

(12) United States Patent
Connors et al.

(10) Patent No.: US 12,376,673 B2
(45) Date of Patent: Aug. 5, 2025

(54) TABLE WITH UMBRELLA HOLDER

(71) Applicant: Advantus Corp., Jacksonville, FL (US)

(72) Inventors: Peter James Connors, Radnor, PA (US); James Peter Connors, Brooklyn, NY (US)

(73) Assignee: Advantus Corp., Jacksonville, FL (US)

( * ) Notice: Subject to any disclaimer, the term of this patent is extended or adjusted under 35 U.S.C. 154(b) by 245 days.

(21) Appl. No.: 18/312,378

(22) Filed: May 4, 2023

(65) Prior Publication Data

US 2024/0099457 A1 Mar. 28, 2024

Related U.S. Application Data

(60) Provisional application No. 63/410,802, filed on Sep. 28, 2022.

(51) Int. Cl.
*A47B 37/04* (2006.01)
*A47B 13/08* (2006.01)

(52) U.S. Cl.
CPC ..... *A47B 37/04* (2013.01); *A47B 13/08* (2013.01)

(58) Field of Classification Search
CPC ..... A47B 37/04; A47B 13/08; A47B 13/083; A47B 2200/0019; A47B 2200/0021; A47B 2200/12
USPC ..... 248/188.1, 346.2, 910, 504; 108/50.12, 108/50.18, 161, 151, 149; D3/10; 135/96, 16
See application file for complete search history.

(56) References Cited

U.S. PATENT DOCUMENTS 4,832,163 A * 5/1989 Levesque ..... A45B 3/00 108/14
5,492,429 A * 2/1996 Hodges ..... E01F 9/685 40/607.04
5,582,471 A * 12/1996 Lin ..... B65F 1/14 108/150
5,672,442 A * 9/1997 Burnett ..... H01M 50/562 439/763
6,299,124 B1 * 10/2001 Reback ..... F16M 11/046 248/527
11,576,510 B1 * 2/2023 Anderson ..... E04H 12/2246
(Continued)

FOREIGN PATENT DOCUMENTS

EP 818594 A1 * 1/1998 ..... E04H 12/2246
FR 2496327 A1 * 6/1982
(Continued)

OTHER PUBLICATIONS

Non-Final Office Action released by the U.S. Patent & Trademark Office on Jul. 16, 2024 for corresponding U.S. Appl. No. 29/854,799; 5 pages.

*Primary Examiner* — Janet M Wilkens
(74) *Attorney, Agent, or Firm* — Smith Gambrell & Russell LLP

(57) ABSTRACT

A table with a molded plastic body and a molded plastic plug fitted in a large round bottom opening in the body. A sealed internal body volume accommodates ballast. An internal hollow sleeve extends from an opening in the top of the body two a hollow core in the plug. An upper and lower corrugated gripping elements in the hollow sleeve and in the hollow core of the plug grip the pole of an umbrella. The round plug retained in the large round bottom opening by spin welding the round plug within the large round bottom opening.

9 Claims, 15 Drawing Sheets

(56) References Cited

U.S. PATENT DOCUMENTS

| | | | | | |
|---|---|---|---|---|---|
| D1,003,638 | S | * | 11/2023 | Anderson | D6/692.1 |
| D1,050,779 | S | * | 11/2024 | Connors | D6/692.3 |
| 2020/0095024 | A1 | * | 3/2020 | Anderson | A47C 7/00 |
| 2022/0104614 | A1 | * | 4/2022 | Schneiderman | E04H 12/2246 |

FOREIGN PATENT DOCUMENTS

| | | | | | |
|---|---|---|---|---|---|
| GB | 2455502 | A | * | 6/2009 | A47B 13/00 |
| KR | 102387404 | B1 | * | 4/2022 | |

* cited by examiner

TABLE WITH UMBRELLA HOLDER

CROSS REFERENCE TO RELATED PATENT APPLICATIONS

This invention claims priority from U.S. Provisional Patent Application No. 63/410,802, filed Sep. 28, 2022, which is hereby incorporated by reference.

FIELD OF THE INVENTION

This invention relates to a table with an umbrella holder and with an internal body volume for holding ballast.

BACKGROUND OF THE INVENTION

Tanning shelves, pool decks, and other outdoor recreational areas often have tables for food, drink, books, electronic devices, and other storage. In order to shield users from the sun, such tables typically have a hole through the top of the table and a lower hole located below the top, both to accommodate the pole of an umbrella. Some existing tables have a hollow body that does not provide sufficient securing of the umbrella to prevent the umbrella dislodging in the wind. Existing tables and bases do not grip the umbrella pole securely. Consequently, when wind catches the umbrella, the umbrella can dislodge and fall over potentially causing damage and injury. Many existing tables have a hole at the top to allow the pole to come through but then require an auxiliary umbrella base at the bottom of the umbrella pole to stabilize the umbrella. Even a table with a hole at the top and a hole at bottom often need the auxiliary base at the bottom of the umbrella pole to secure the umbrella.

SUMMARY OF THE INVENTION

The table of the present invention has a molded plastic body. The molded plastic body has a generally oval-shaped top and a round bottom. A continuous side wall connects the top and bottom together to form a sealed internal body volume. Ballast, generally water, can be loaded into the internal body volume through a fill opening that can be sealed by means of a stopper. In colder climates, the water can be drained through the fill opening in order to avoid freezing and damaging the body of the table.

The bottom of the molded plastic body has a round bottom opening to accommodate a molded plastic round plug. The round bottom opening is located outside of the sealed internal body volume.

The body of the table has an internal hollow sleeve extending downward from an opening in the top of the body of the table toward a hollow core in the round plug located in the round bottom opening at the bottom of the molded plastic body. An upper corrugated gripping element is positioned in the hollow sleeve near the opening in the top of the body to accommodate and to grip the pole of an umbrella. A similar lower corrugated gripping element is positioned in the hollow core of the molded plastic plug in order to accommodate and to grip the pole of an umbrella. The upper corrugated gripping element and the lower corrugated gripping element together secure the umbrella pole vertically within the hollow sleeve and the hollow core of the round plug. Further, flexibility in the gripping elements allow the body of the table to accommodate umbrella poles of varying size.

The round plug is fitted in and retained in the large round bottom opening by spin welding the round plug within the large round bottom opening. In addition, the round plug has an internal volume that can be filled with ballast, generally water, through a plug fill hole with a stopper. The round plug has an air bleed opening that communicates with the hollow core in order to allow the escape of air as the internal volume of the plug is filled with ballast.

Further objects, features and advantages will become apparent upon consideration of the following detailed description of the invention when taken in conjunction with the drawings and the appended claims.

DETAILED DESCRIPTION OF THE PREFERRED EMBODIMENTS

Figure 7:
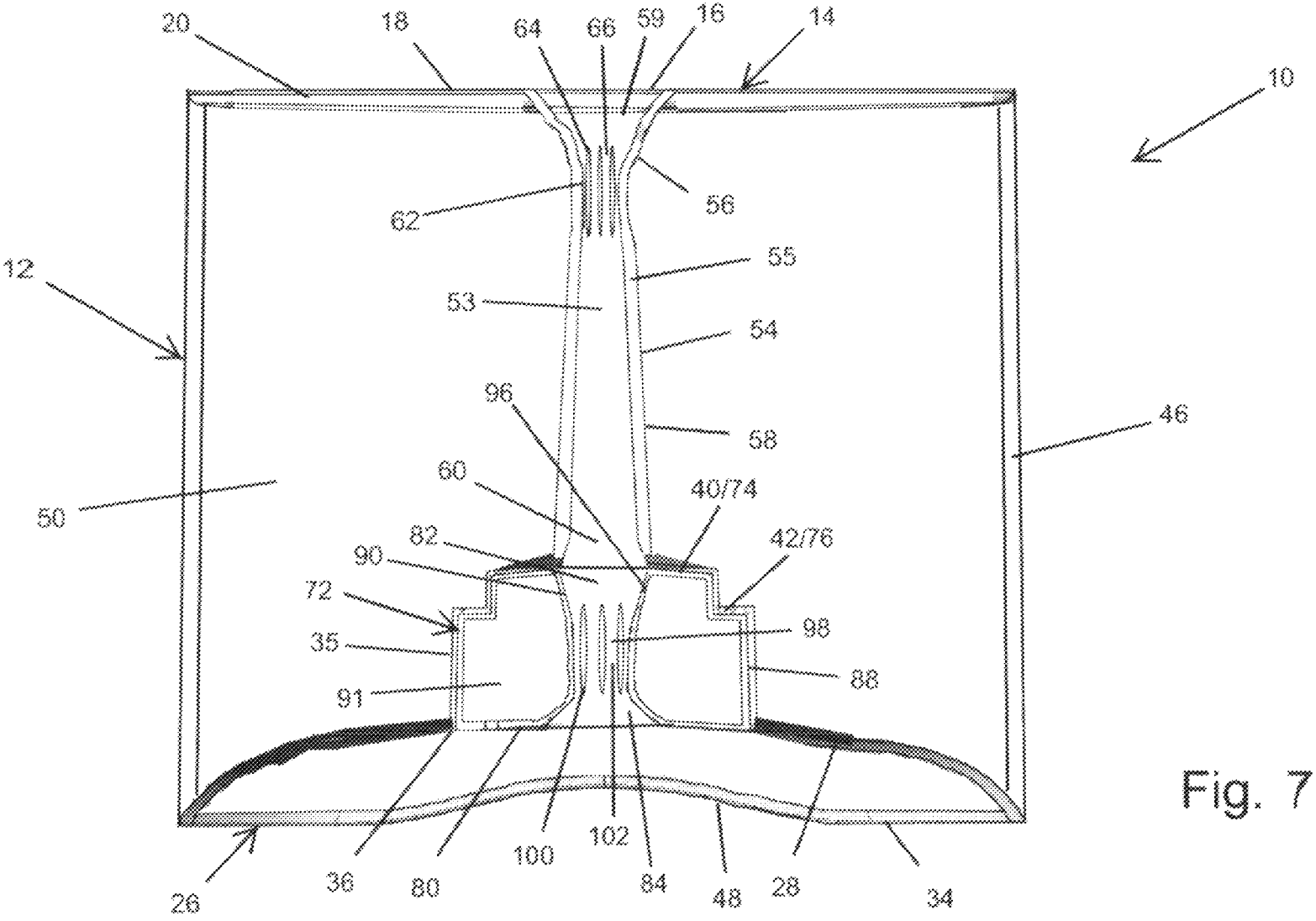
FIG. 7 is a section view of the table with an umbrella holder as seen along line 7-7 of FIG. 5 in accordance with the present invention.

FIGS. 1-7 show a table 10 having a body 12 and round plug 72. Both the body 12 and the round plug 72 are constructed of molded polyethylene. The body 12 of the table 10 comprises an oval top 14, a round bottom 26, and a continuous body side wall 46. The body side wall 46 connects the oval top 14 and the round bottom 26 together in order to support the oval top 14 and to create a watertight internal body volume 50 (FIG. 7). The watertight internal body volume 50 is defined by the oval top 14, the body side wall 46, the round bottom 26, the wall 55 of a hollow sleeve 54, and the outside wall 35 of a large round opening 36 in the bottom 26 of the body 12.

Figure 1:
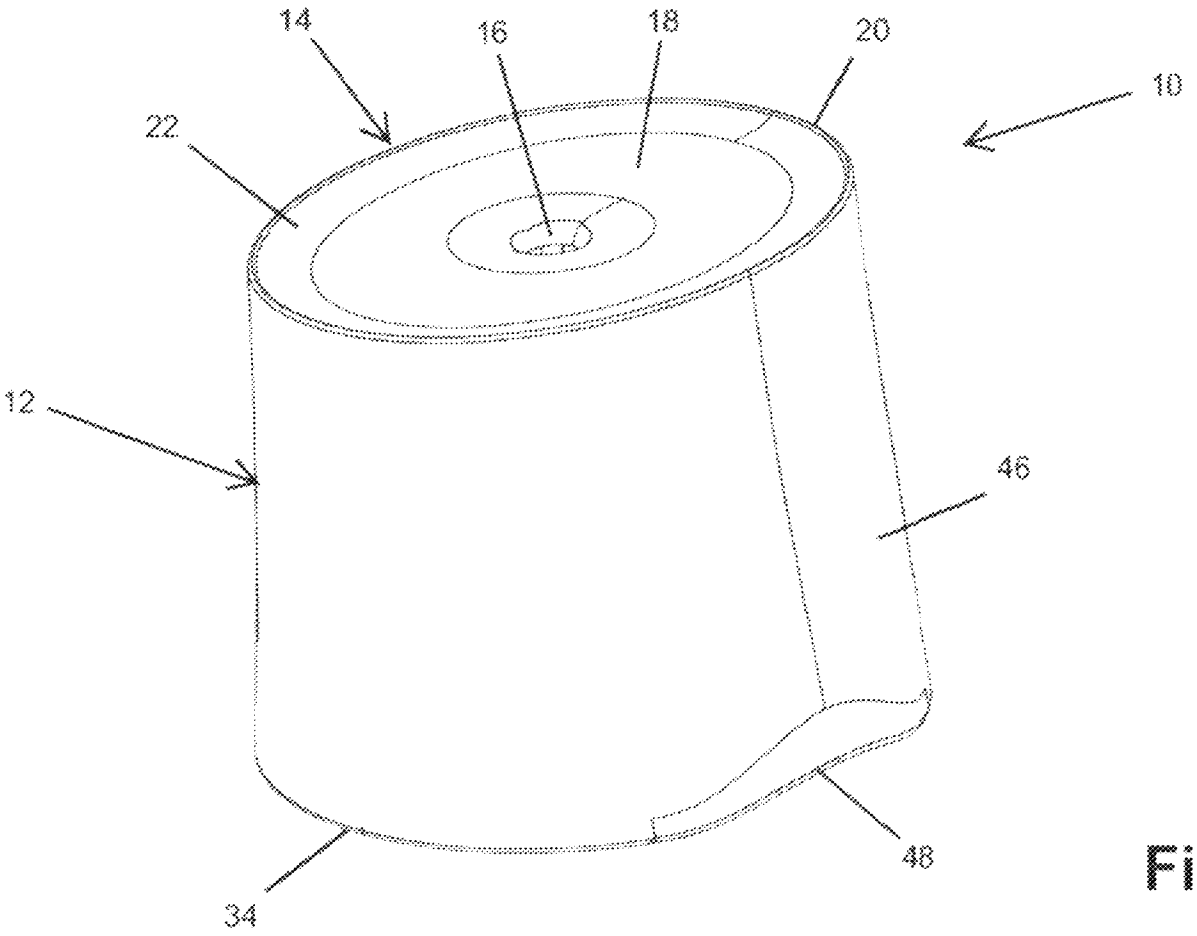
FIG. 1 is a top perspective view of a table with an umbrella holder in accordance with the present invention.
Figure 3:
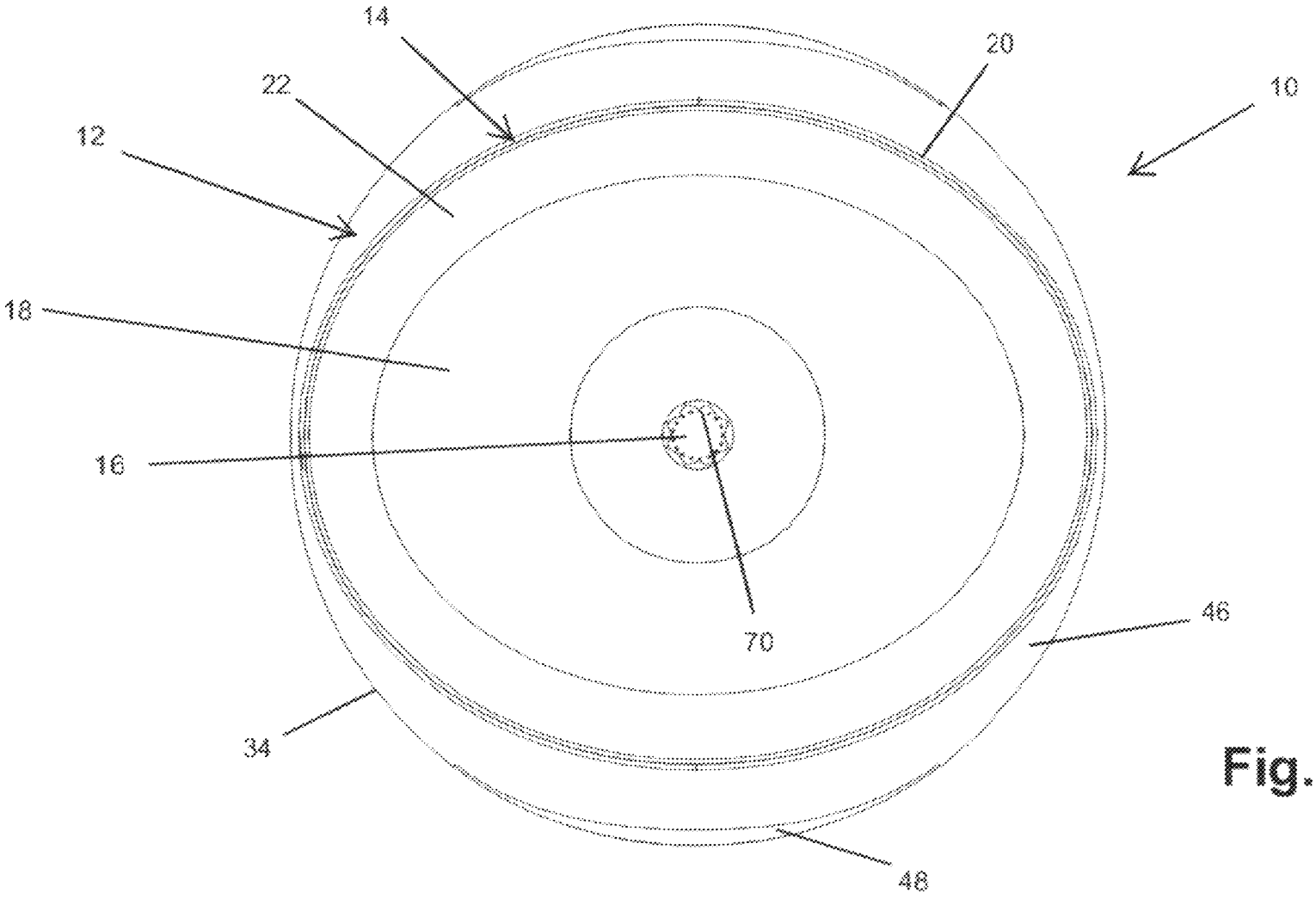
FIG. 3 is a top plan view of the table with an umbrella holder in accordance with the present invention.

As best seen in FIGS. 1 and 3, the oval top 14 has a center opening 16 to accommodate the pole of an umbrella as will be described in greater detail below. The oval top 14 has a top periphery 20, a top raised peripheral lip 22, and a planar surface 18. The peripheral lip 20 and the planar surface 18 both slope toward the center opening 16 so that liquids that impinge the top 14 will drain into the center opening 16 and out a lower plug opening 84. The raised peripheral lip 22 restraints items from rolling off the edge of the top 14.

Figure 2:
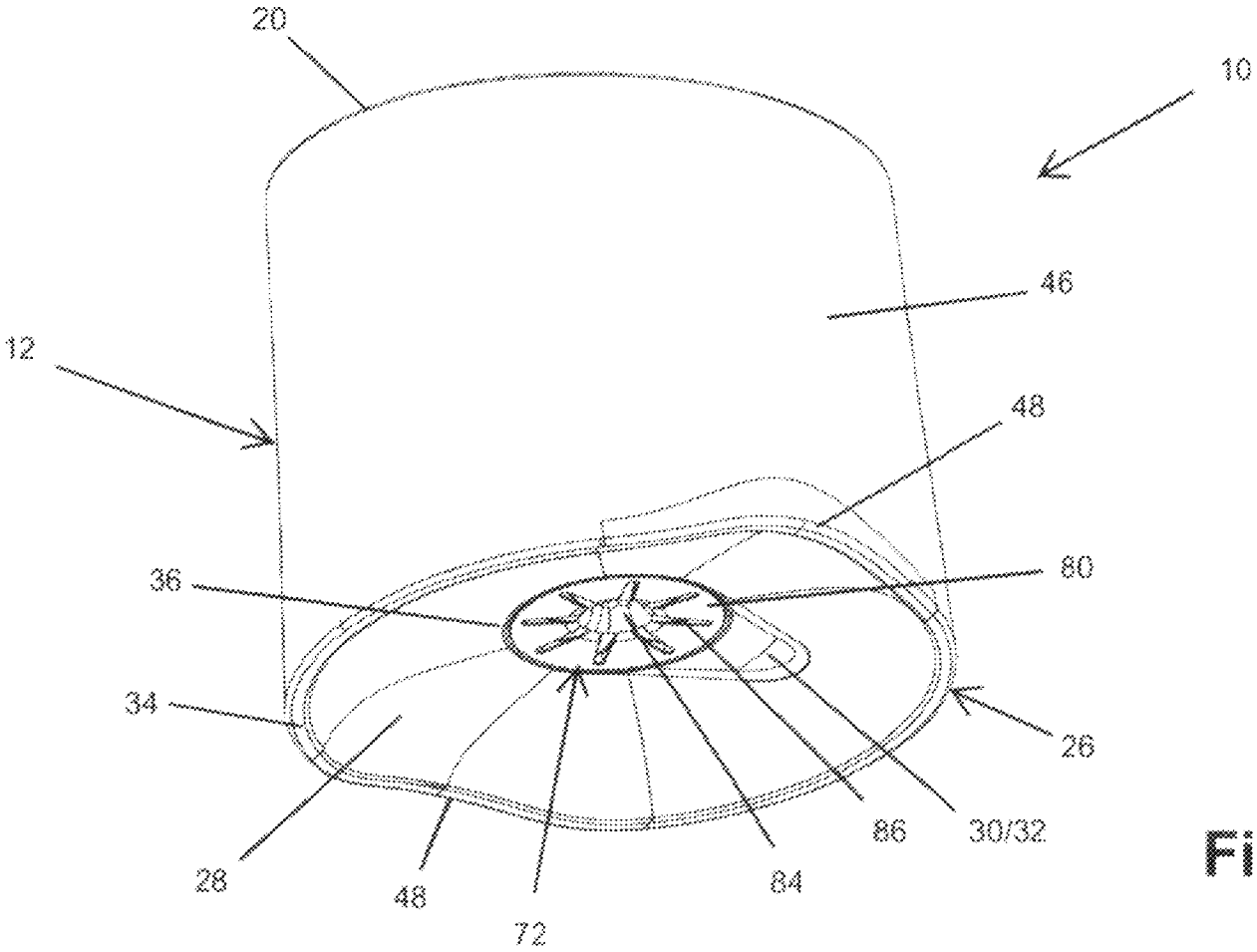
FIG. 2 is a bottom perspective view of the table with an umbrella holder in accordance with the present invention.
Figure 4:
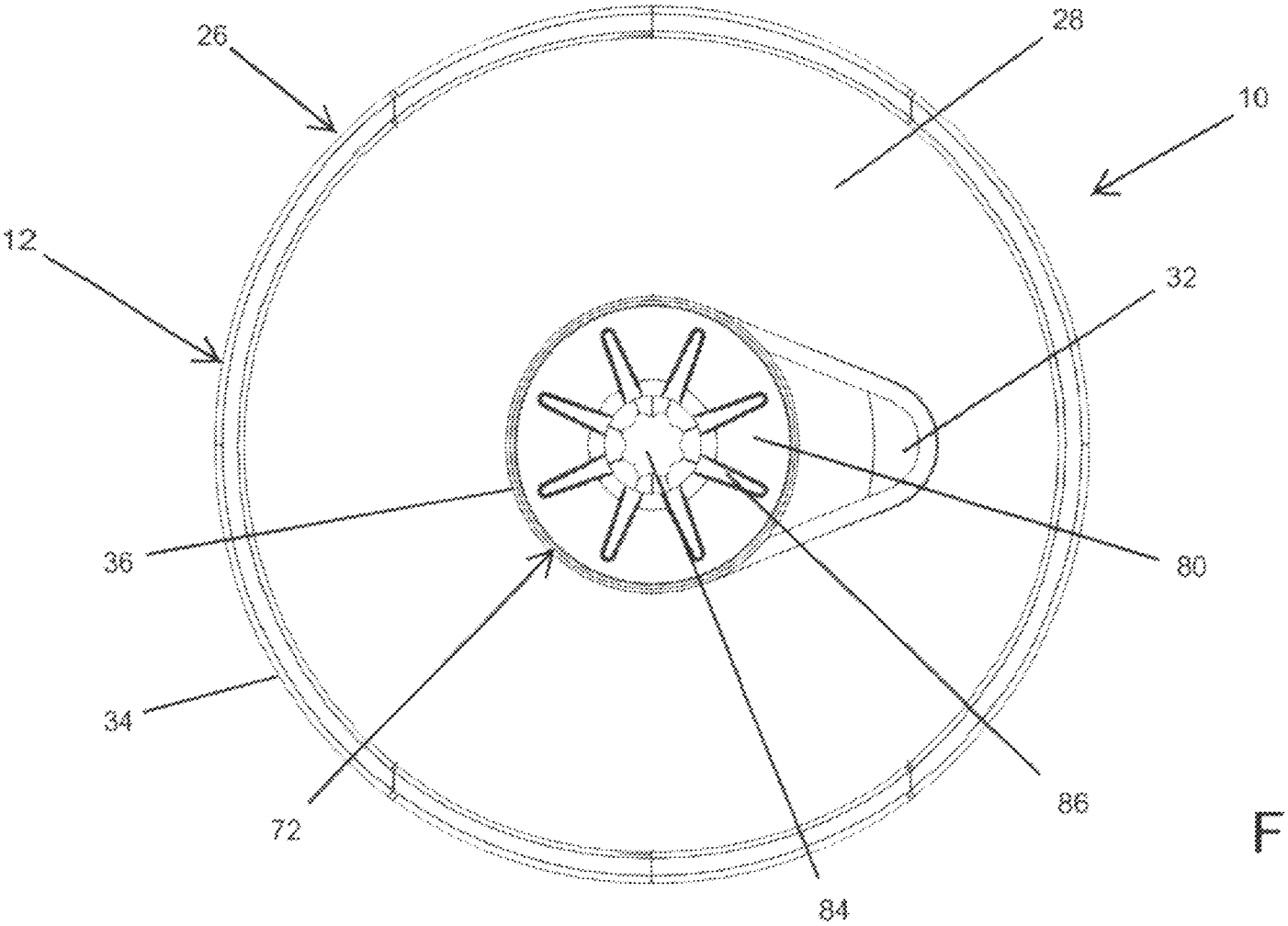
FIG. 4 is a bottom plan view of the table with an umbrella holder in accordance with the present invention.
Figure 5:
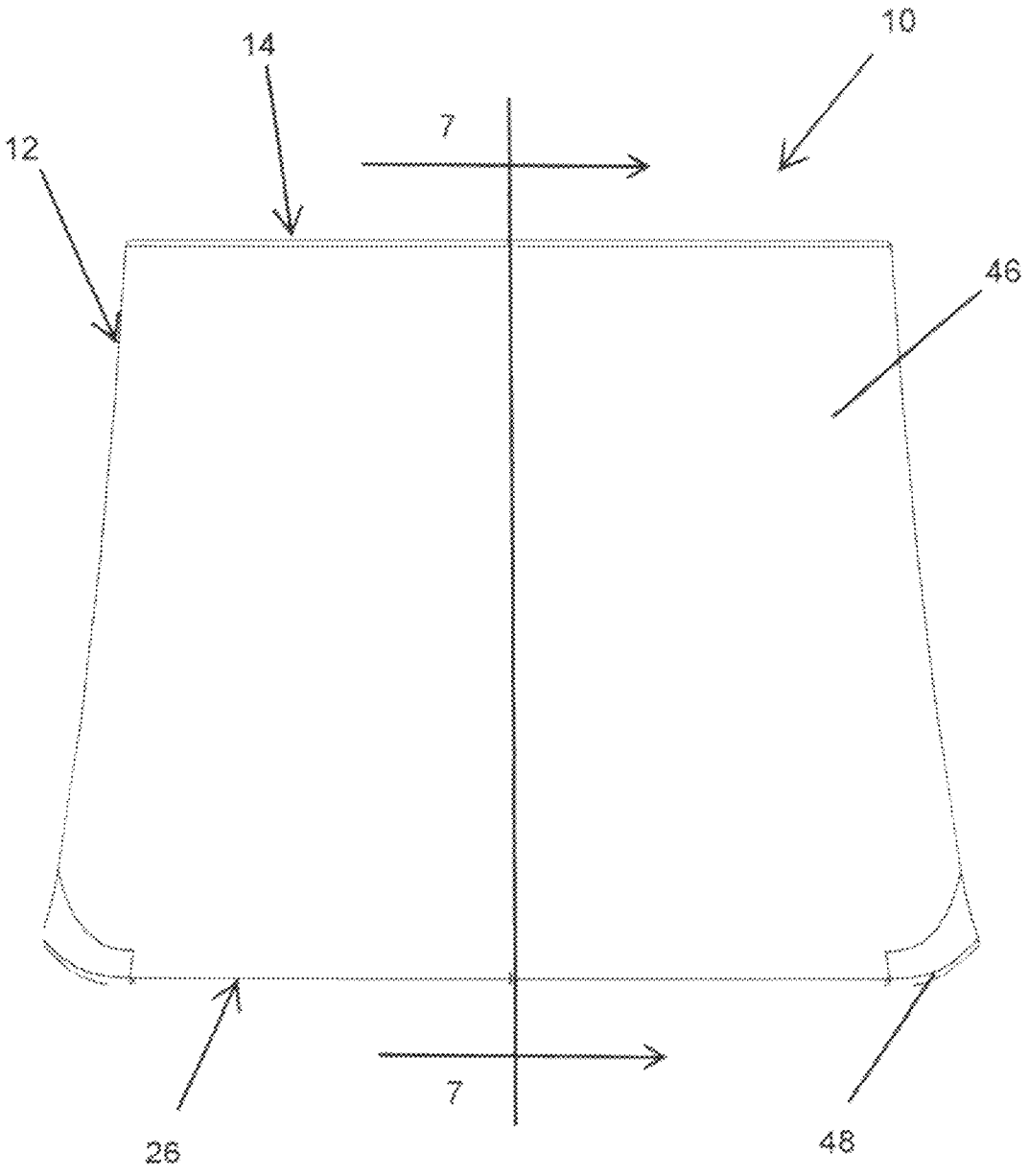
FIG. 5 is a front elevation view of the table with an umbrella holder in accordance with the present invention. The back elevation view of the table with an umbrella holder is the same as the front elevation view.
Figure 6:
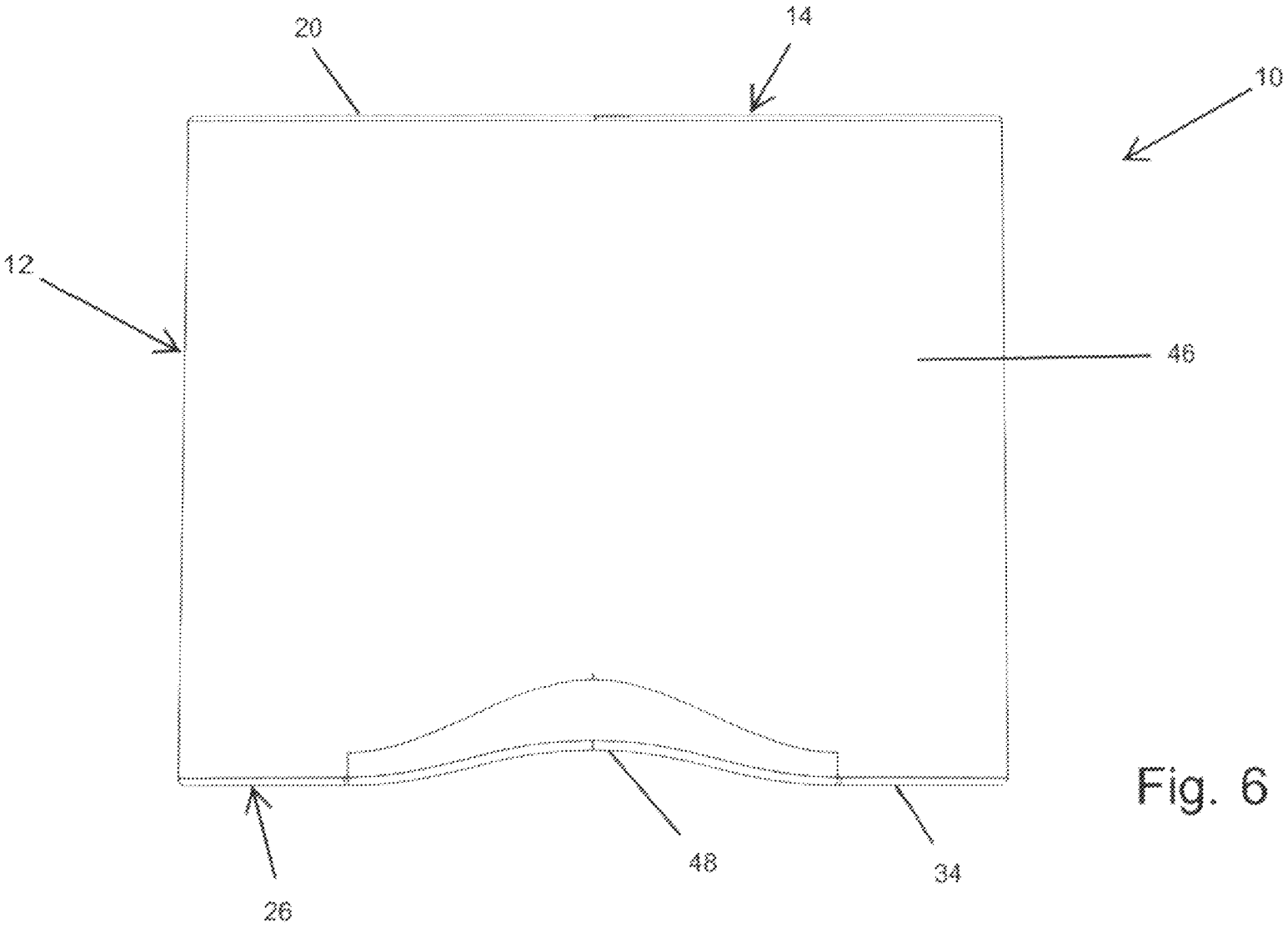
FIG. 6 is a side elevation view of the table with an umbrella holder in accordance with the present invention. Both side elevation views are the same.

As best seen in FIGS. 2 and 4, the round bottom 26 has a bottom periphery 34, an arched bottom surface 28, and a large opening 36 to accommodate a round plug 72 to be described in greater detail below. The bottom 26 also has a fill opening 30 and a stopper 32. The fill opening 30 provides access to the internal body volume 50 so that the internal body volume 50 can be filled with water or other ballast in order to stabilize the table. The stopper 32 seals the internal body volume 50 once it has been filled with ballast. The periphery 34 has indentations 48 on opposite sides. The indentations provide convenient handles for lifting the table 10.

With reference to FIG. 7, the hollow sleeve 54 has an upper section 56 with an upper sleeve hole 59 and a lower section 58 with a lower sleeve hole 60. The hollow sleeve 54 extends downwardly from the center opening 16 in the oval top 14 to the lower sleeve hole 60 adjacent the round plug 72. The upper section 56 of the hollow sleeve 54 is tapered and extends downwardly from the opening 16 in the top 14. The lower section 58 of a hollow sleeve 54 is tapered and extends downwardly from the tapered upper section 56 and terminates in lower sleeve hole 60. The internal volume 53 of the hollow sleeve 54 is outside of the internal body volume 50 of the table 10.

An upper corrugated gripping element 62 is located within the upper section 56 of the hollow sleeve 54. The gripping element 62 constitutes a series of inwardly extending ribs 64 spaced around the inside circumference of the upper section 56. The ribs 64 create complementary valleys 66 between the ribs 64. The inward extension of the ribs 64 creates an upper rib circumference 70 (FIG. 3). When an umbrella pole that is slightly larger than the rib circumference 70 is inserted into the opening 16 in the top 14 and through the gripping element 62, the ribs 64 flex creating a friction engagement between the umbrella pole and the upper section 56. Consequently, the gripping element 62 can accommodate variations in the size of the umbrella pole.

Figure 8:
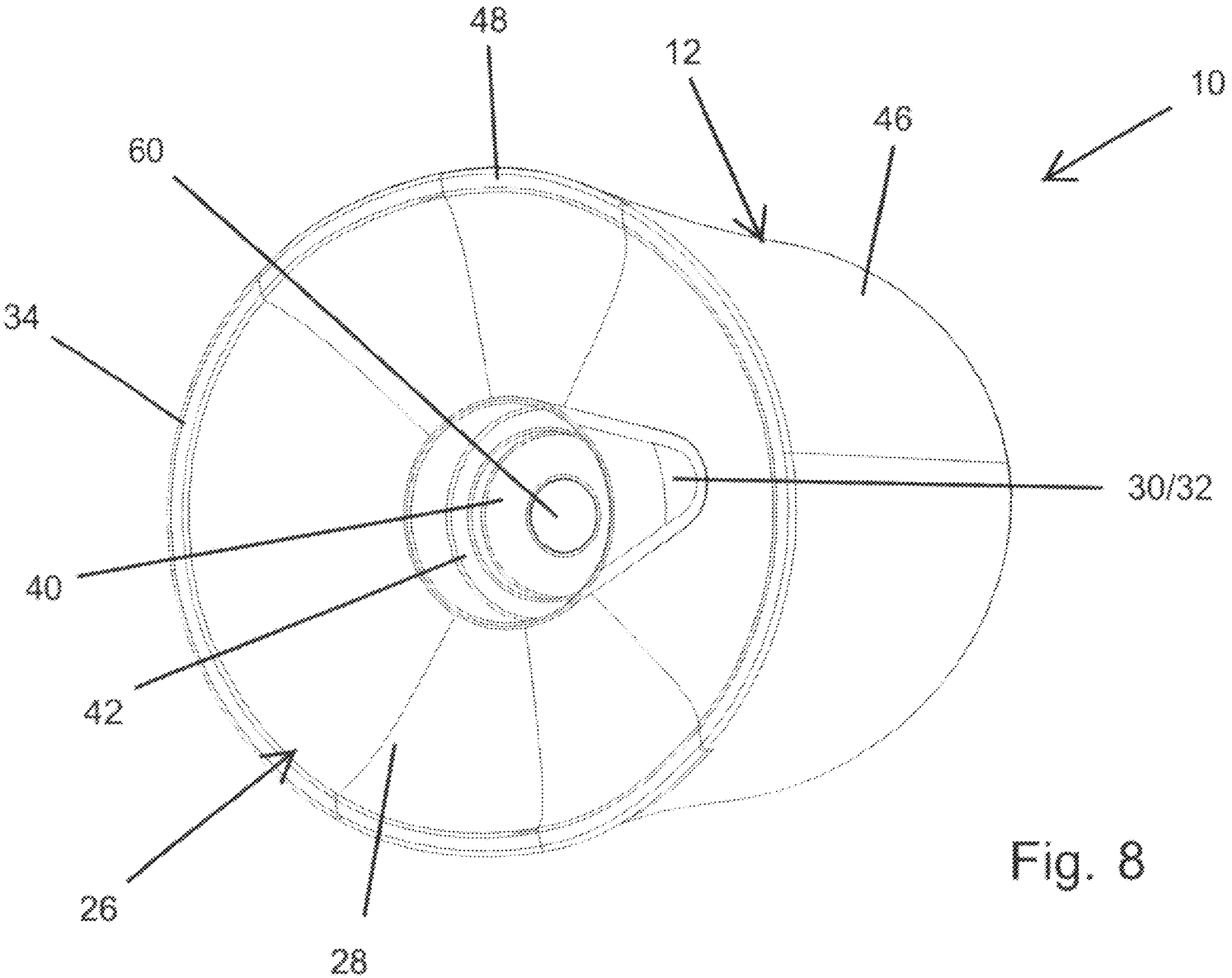
FIG. 8 is a bottom perspective view of the body of the table with the plug of the table removed in accordance with the present invention.
Figure 9:
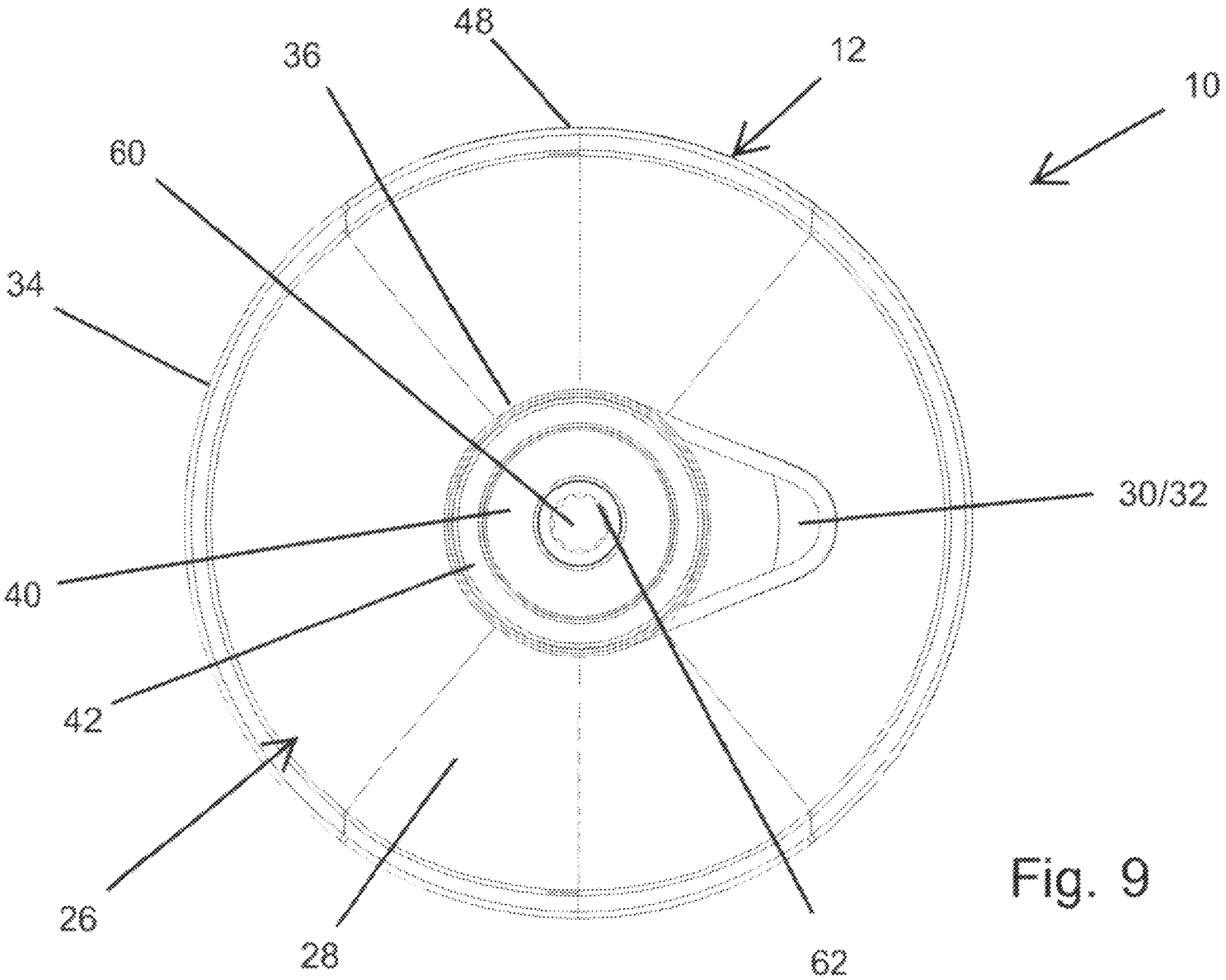
FIG. 9 is a bottom plan view of the body of the table with the plug of the table removed in accordance with the present invention.
Figure 10:
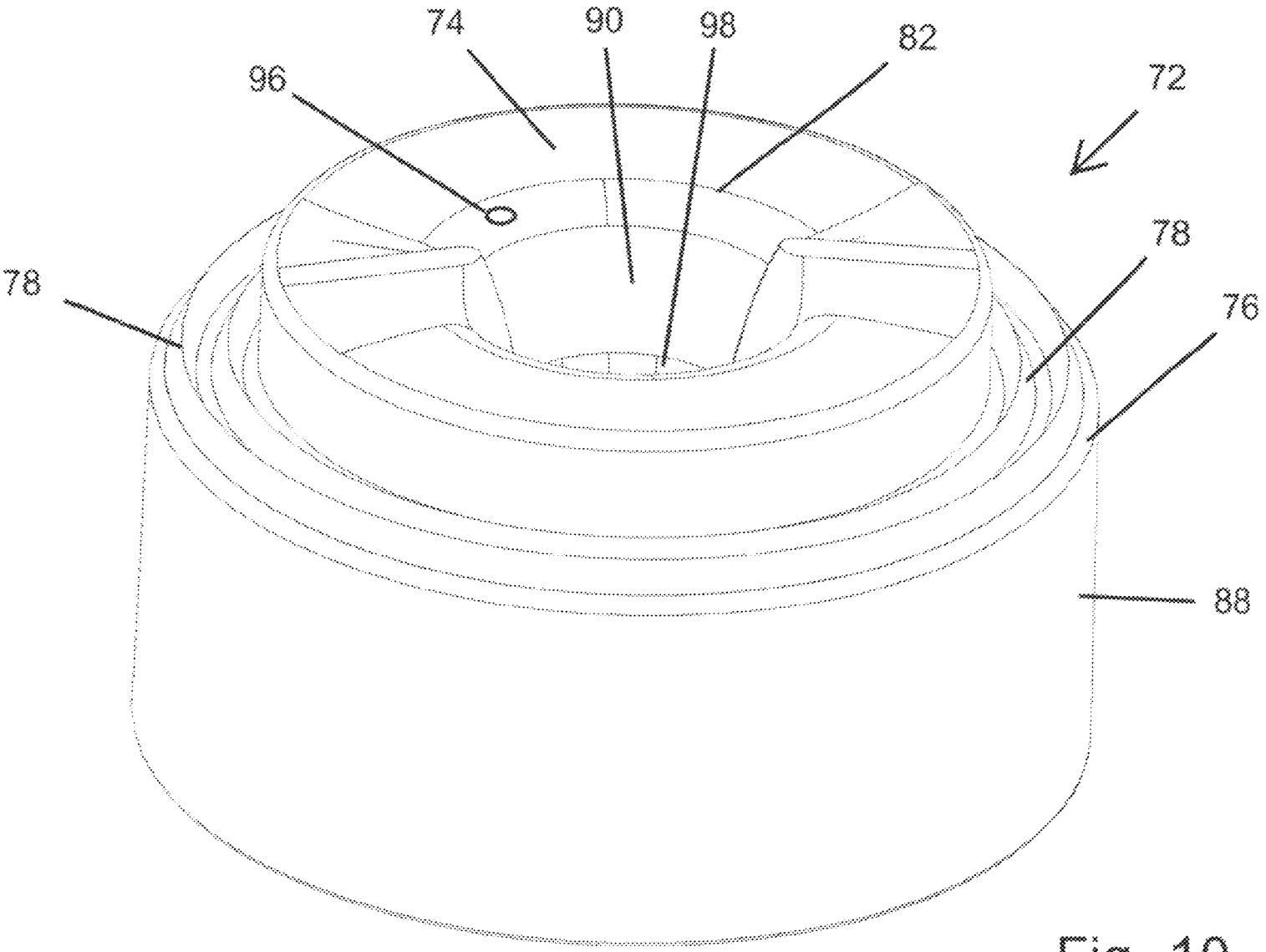
FIG. 10 is a top perspective view of the plug of the table in accordance with the present invention.
Figure 11:
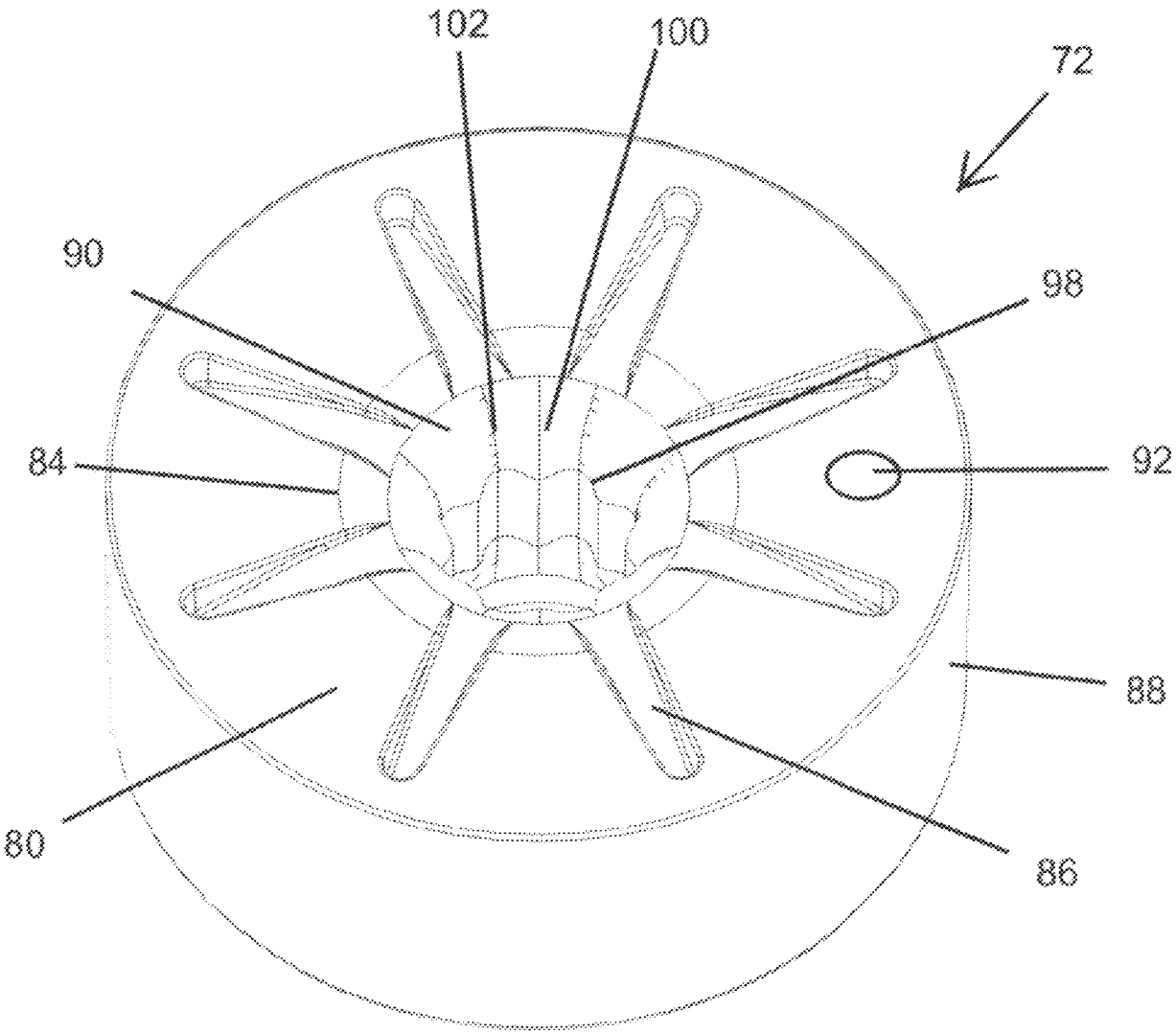
FIG. 11 is a bottom perspective view of the plug of the table in accordance with the present invention.

With reference to FIGS. 8 and 9, the table 10 is shown with the round plug 72 removed exposing the construction of the large round bottom opening 36 that accommodates the plug 72. The plug 72 is outside of the internal body volume 50 of the body 12. In downward descending order, the bottom opening 36 has lower sleeve hole 60 surrounded by an upper contact flange 40 and an intermediate welding flange 42. The upper corrugated gripping element 62 is visible through the opening 60 in FIG. 9.

FIGS. 10-15 show the construction of the round plug 72 that fits in the large round opening 36 of the table body 12. In downward descending order, the round plug 72 has a top flange engaging surface 74, an intermediate flange welding surface 76 with welding ridges 78, a plug side wall 88, and a bottom plug surface 80. The round plug 72 has a hollow core 90 with a tapered upper plug opening 82 and a lower plug opening 84. Together, the plug side wall 88, the inside surface of the top flange engaging surface 74, the inside surface of the intermediate flange welding surface 76, the outside surface of the hollow core 90, and the inside of the plug bottom 80 define a plug internal volume 91. The plug bottom 80 has a plug fill hole 92 that will accommodate a stopper. The hollow core 90 has an air bleed opening 96 adjacent the tapered upper plug opening 82 and communicating with the inside of the hollow core 90. The plug internal volume 91 can be filled with ballast such as water. As the plug internal volume 91 is filled with ballast, the air within the internal volume 91 can escape to atmosphere through the bleed openings 96 and then through the lower plug opening 84 or the top center opening 16.

Figure 12:
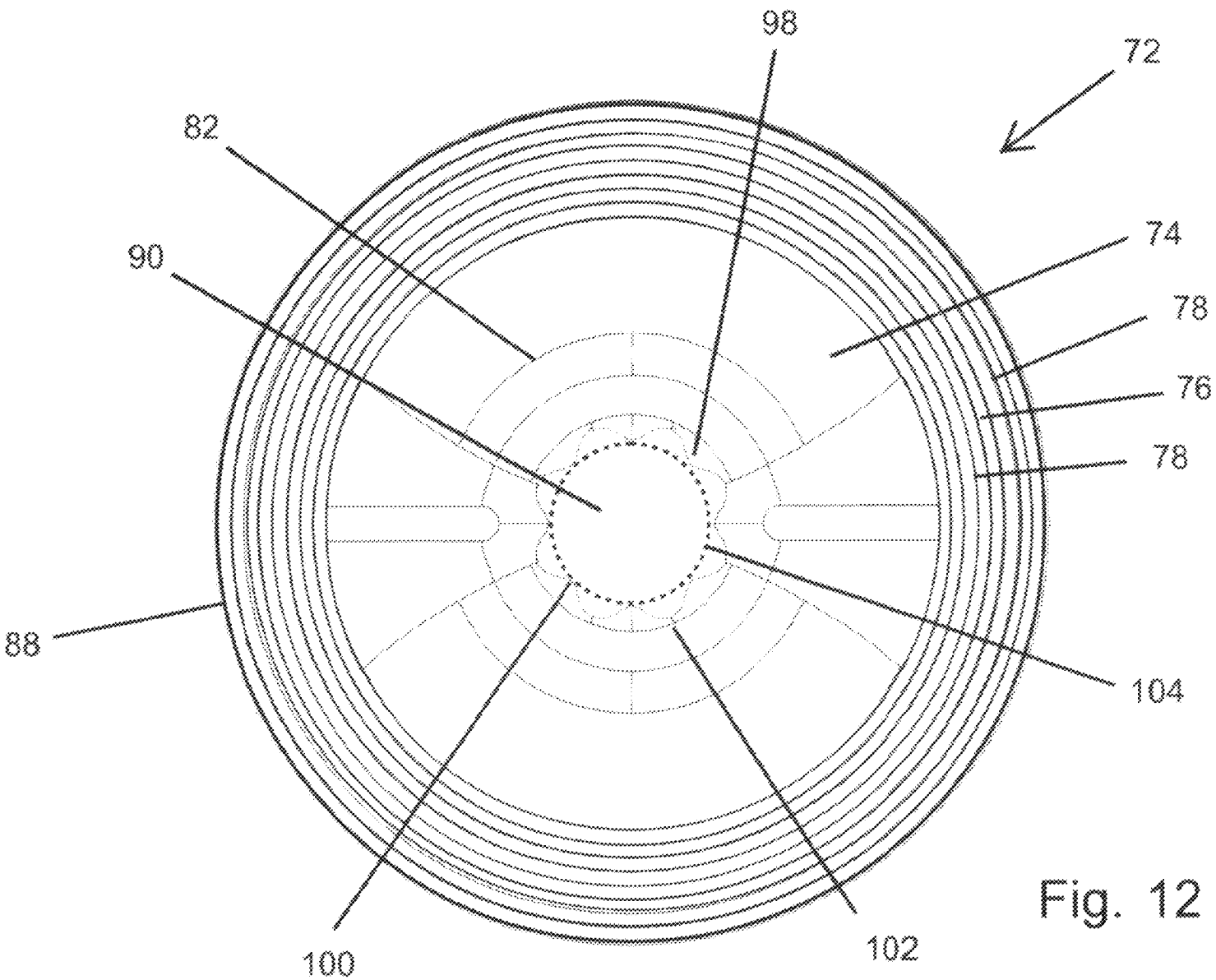
FIG. 12 is a top plan view of the plug of the table in accordance with the present invention.
Figure 13:
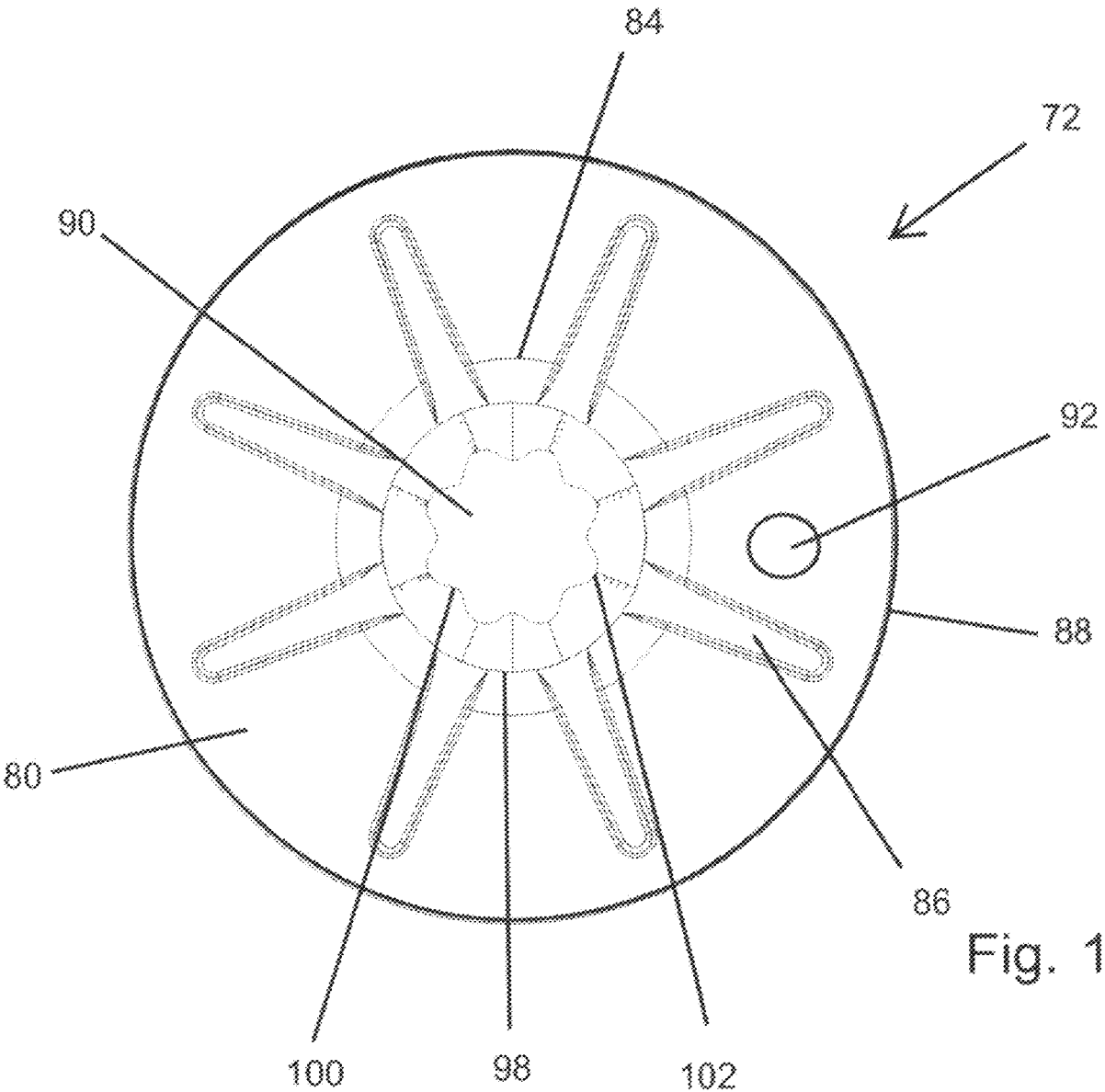
FIG. 13 is a bottom plan view of the plug of the table in accordance with the present invention.
Figure 14:
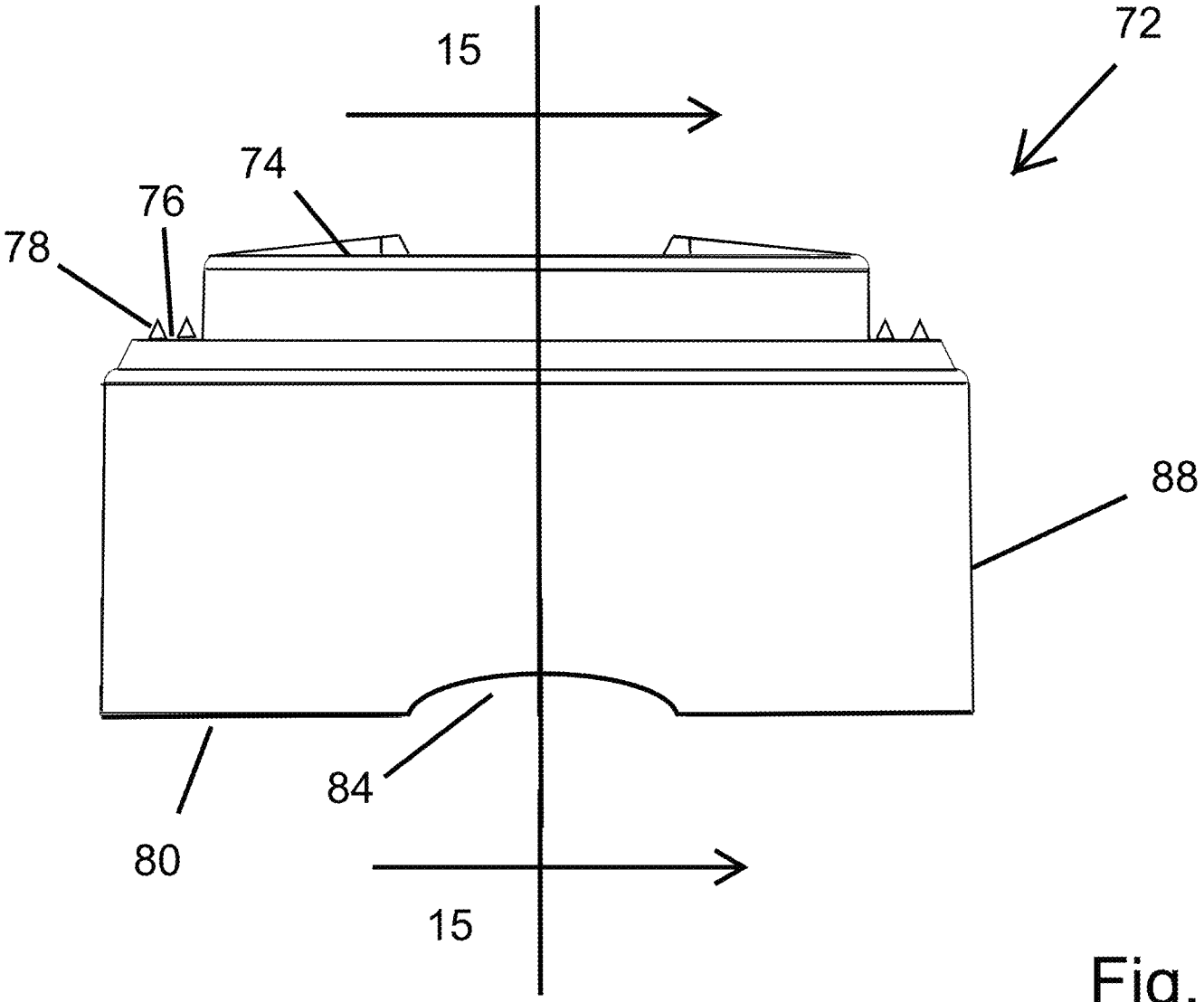
FIG. 14 is a side elevation view of the plug of the table in accordance with the present invention.
Figure 15:
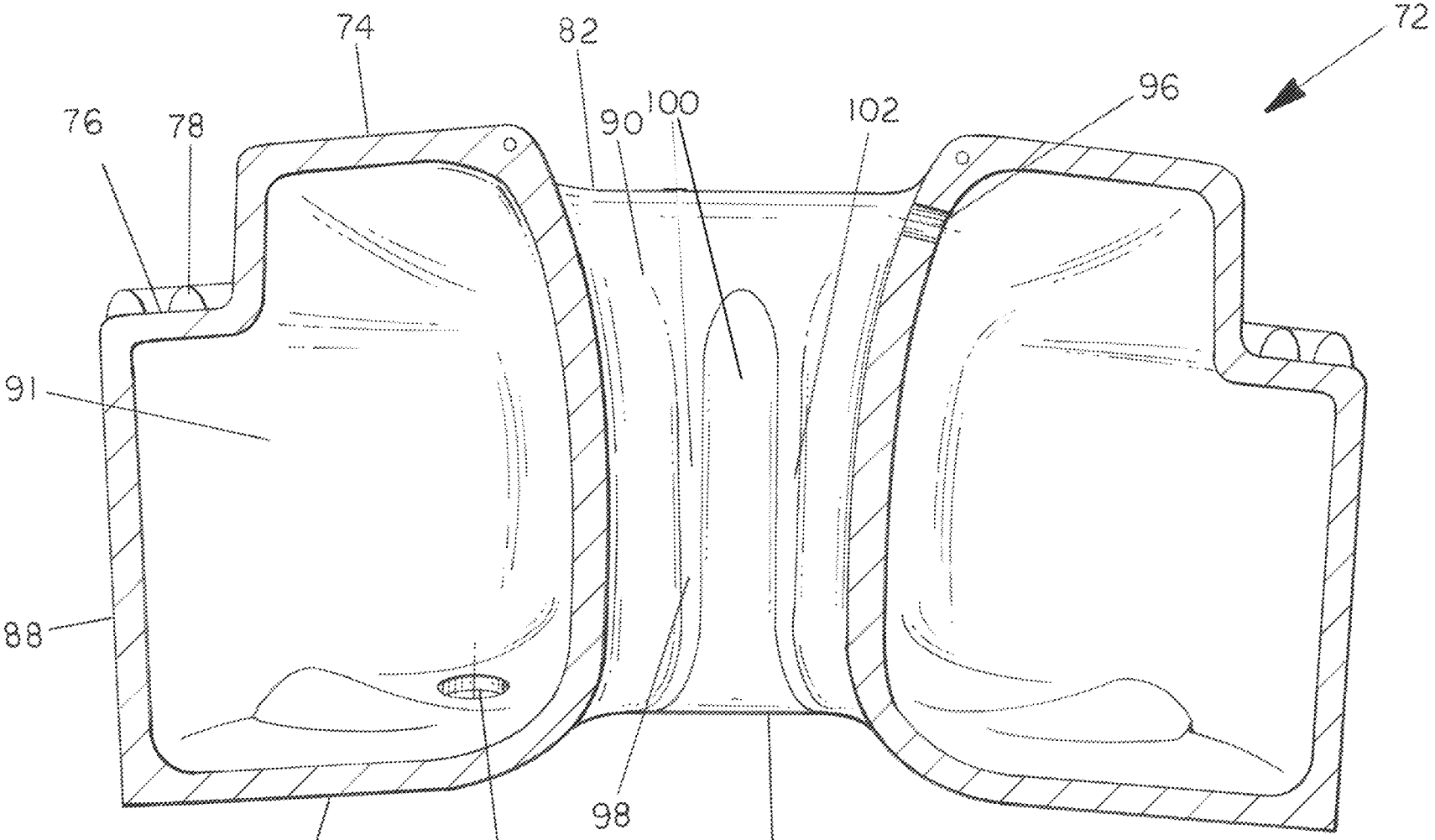
FIG. 15 is a section view of the plug of the table as seen along line 15-15 of FIG. 14 in accordance with the present invention.

The hollow core 90 has lower corrugated gripping element 98 consisting of ribs 100 extending around the internal circumference of the hollow core 90. The ribs 100 define complementary valleys 102. The inward projection of the ribs 100 define a lower rib circumference 104 (FIG. 12). As previously described in connection with upper corrugated gripping element 62, the ribs 100 flex in order to frictionally engage and secure the pole of the umbrella.

In order for the table to properly grip the umbrella pole, the upper rib circumference 70 and the lower rib circumference 104 should be approximately equal in circumference. Because the hollow sleeve 54 requires draft in order to remove the table from the mold, the upper rib circumference 70 cannot be duplicated at the lower end of the hollow sleeve 54 in a single molding operation. In order to provide the upper rib circumference 70 that is equal to the lower rib circumference 104, the lower corrugated gripping element 98 must be molded as part of a separate piece, namely the round plug 72, in a separate molding operation.

In order to install the separately molded round plug 72 in the large round opening 36, the round plug is rotated with respect to the body 12 at a rate approaching 1000 rpm within the large round opening 36. The rotation of the round plug 72 is accomplished by chucking grooves 86 that engage the chuck of a rotating tool. By spinning the round plug 72 within the large round opening 36, the welding ridges 78 melt as a result of friction between the welding ridges 78 and the intermediate welding flange 42 (FIGS. 7, 8, and 9) of the large round opening 36. After the welding ridges 78 have melted, the body 12 and the round plug 72 are allowed to cool thereby permanently securing the round plug 72 within the large round bottom opening 36 of the body 12.

While this invention has been described with reference to preferred embodiments thereof, it is to be understood that variations and modifications can be affected within the spirit and scope of the invention as described herein and as described in the appended claims.

We claim:

1. A table comprising:

a. a geometrically shaped top including a top opening;

b. a geometrically shaped bottom including a large bottom opening;

c. a body side wall connecting the top to the bottom, wherein the top, the bottom, and the side wall are sealed to define an internal volume;

d. a hollow sleeve with an upper sleeve hole and a lower sleeve hole; and e. a separate plug for insertion into the bottom opening. the plug having a hollow core that connects to the lower sleeve hole of the hollow sleeve, the plug further having a lower corrugated gripping element, wherein the upper sleeve hole engages the top opening and extends toward the bottom opening, wherein the hollow sleeve is isolated from the internal volume, and wherein the hollow sleeve has an upper corrugated gripping element adjacent the top opening.

2. The table of claim 1, wherein the geometrically shaped top is oval in shape and the geometrically shaped bottom is round in shape.

3. The table of claim 1, wherein the upper corrugated gripping element comprises a series of inwardly facing flexible ridges.

4. A table comprising:

a. a geometrically shaped top including a top opening;

b. a geometrically shaped bottom including a large bottom opening;

c. a body side wall connecting the top to the bottom, wherein the top, the bottom, and the side wall define an internal volume; and d. a hollow sleeve with an upper sleeve hole and a lower sleeve hole, wherein the upper sleeve hole engages the top opening and extends toward the bottom opening, wherein the hollow sleeve is isolated from the internal volume, wherein the hollow sleeve has an upper corrugated gripping element adjacent the top opening, and wherein the hollow sleeve has an increasing taper from the upper corrugated gripping element toward the upper sleeve hole and has an increasing taper from the upper corrugated gripping element toward the lower sleeve hole.

5. The table of claim 4, wherein the large bottom opening accommodates and secures a round plug with a hollow core, wherein the hollow core comprises an upper plug opening and a lower plug opening and wherein the upper plug opening communicates with the lower sleeve hole of the hollow sleeve.

6. The table of claim 5, wherein the hollow core of the plug includes a lower corrugated gripping element.

7. The table of claim 6, wherein the lower corrugated gripping element comprises a series of inwardly facing flexible ridges.

8. The table of claim 5, wherein the plug has a plug internal volume.

9. The table of claim 5, wherein the hollow core of the plug has an increasing taper from the lower corrugated gripping element toward upper plug opening and has an increasing taper from the lower corrugated gripping element toward a lower plug opening.

* * * * *